United States Patent [19]

Konishi

[11] Patent Number: 4,711,358

[45] Date of Patent: Dec. 8, 1987

[54] COUNTERBALANCING TYPE CRANE

[75] Inventor: Keiichi Konishi, Akashi, Japan

[73] Assignee: Kabushiki Kaisha Kobe Seiko Sho, Kobe, Japan

[21] Appl. No.: 832,411

[22] Filed: Feb. 24, 1986

[30] Foreign Application Priority Data

Mar. 4, 1985 [JP] Japan ..... 60-42426

[51] Int. Cl.[4] ..... B66C 23/72

[52] U.S. Cl. ..... 212/178; 212/196

[58] Field of Search ..... 212/178, 195, 196, 198, 212/197

[56] References Cited

U.S. PATENT DOCUMENTS

| | | | |
|---|---|---|---|
| 3,278,045 | 10/1966 | Potter et al. | 212/178 |
| 3,930,583 | 1/1976 | Jouffray | 212/195 |
| 4,540,097 | 9/1985 | Wadsworth et al. | 212/198 |
| 4,579,234 | 4/1986 | Delago et al. | 212/178 |
| 4,614,275 | 9/1986 | Zenno | 212/198 |

FOREIGN PATENT DOCUMENTS

| | | | |
|---|---|---|---|
| 52-53353 | 4/1977 | Japan | 212/196 |

*Primary Examiner*—Joseph F. Peters, Jr.

*Assistant Examiner*—Thomas J. Brahan

*Attorney, Agent, or Firm*—Oblon, Fisher, Spivak, McClelland, & Maier

[57] ABSTRACT

A counterbalancing type crane including a crane body provided with a travelling unit and a swing unit, a tiltable boom for hanging a load through a hoisting line, a tiltable mast, a boom guy line disposed between an upper portion of the mast and an upper portion of the boom, the boom guy line being changeable in length, a mast guy line attached at an upper end thereof to the upper portion of the mast, a gantry disposed at a rear portion of the swing unit, and a counterweight car with a counterweight placed thereon. The counter weight car is vertically pivotably and removably connected to the rear portion of the swing unit through a connecting arm, a strut is connected between an upper portion of the counterweight car and an upper portion of the gantry, a guy rope is connected between the upper portion of the counterweight car and the swing unit below the gantry, and a lower end of the mast guy line is attached to the counterweight car so that it can be detached therefrom and attached to an upper end portion of the gantry.

2 Claims, 10 Drawing Figures

COUNTERBALANCING TYPE CRANE

BACKGROUND OF THE INVENTION (1) Field of the Invention

The present invention relates to a counter balancing type crane having a counterweight car located behind a crane body.

(2) Description of the Prior Art

A counterbalancing type crane in which, in order to hoist a large load, a counterweight carriage car is disposed behind a crane body in addition to a counterweight attached to the crane body, has heretofore been well known as disclosed in U.S. Pat. No. 3,842,984. This conventional counter balancing type crane is of such a structure as schematically shown in FIG. 10. As shown therein, a crane body 101 comprises a travelling unit 103 and a swing unit 104 disposed on the travelling unit 103; a boom 105 and mast 106 are attached tiltably to the crane body 101; a first guy line 107 for supporting the boom 105 is provided between an upper portion of the boom 105 and an upper portion of the mast 106; a second guy line 108 is provided between the upper portion of the mast 106 and a rear portion of the crane body 101; a counterweight car 121 is vertically rockably connected to the rear portion of the crane body 101 vertically rockably through a connecting arm 123; and a third guy line 109 is provided between the counterweight car 121 and the upper portion of the mast 106. When a hanging load W acts on the mast 106 from the boom 105 through the first guy line 107, the third guy line 109 is stretched and the weight of the counterweight car 121 resists the hanging load W. When a larger hanging load W acts on the mast to raise the counterweight car 121, the second guy line 108 is also stretched, so that not only the weight of the counterweight 121 but also the weight of the crane body 101 resists the load W.

In such structure, however, when the weight of the crane body 101 also comes to serve as resistance under the action of the large hanging load W, the resisting force from the crane body 101 acts on the mast 106 through the second guy line 108 whose angle relative to the mast 106 is comparatively small, as will be discussed hereinafter , so that a compressive load applied to the mast 106 increases remarkably, thus requiring the mast 106 to have a high strength. Further, the counter weight car 121 is desired to function so as to prevent the crane from falling sideways, but in the above structure the connection between the crane body 101 and the counterweight car 121 is merely through the connecting arm 123, that is, the connection strength in a torsional direction is poor, so this portion will be damaged under action of a force exerted in a sideways falling direction of the crane, and thus it is impossible to prevent the crane from falling sideways.

This type of crane can also be used as an ordinary crane by removing the counterweight car 121. In this connection, it is desired to facilitate rearrangement between the counterbalancing type crane using the counterweight car 121 and an ordinary type crane. In this case, the above conventional structure involves the problem of how to handle the guy line 109 disposed between the upper portion of the mast 106 and the --counterweight car 121. More particularly, when rearranging from the counterbalancing type crane into an ordinary type crane, the third guy line 109 becomes unnecessary. A lower end of the guy line 109 is removed from the -counterweight car 121, but if it is then attached to the crane body 101, it may contact and interfere with another rope or object. To avoid this, it is necessary to bring the mast 106 down to the ground and remove the third guy line 109 from the mast. This operation has been found to be very troublesome.

SUMMARY OF THE INVENTION

The present invention has been accomplished in view of the above circumstances and it is the object of the present invention to provide a counterbalancing type crane capable of allowing the weight of a counterweight car and that of a crane body to serve as resistance to a hanging load W, capable of reducing a compressive load applied to a mast in comparison with the prior art, capable of enhancing the function to prevent the crane from falling sideways, capable of being used also as an ordinary type crane by removing the counter weight car from the crane body and capable of facilitating rearrangement for use as an ordinary type crane.

According to the present invention there is provided a counterbalancing type crane including a crane body provided with a travelling unit and a swing unit, a tiltable boom for hanging a load through a hoisting line, a tiltable mast, a boom guy line disposed between an upper portion of the mast and an upper portion of the boom, the boom guy line being changeable in length, a mast guy line attached at an upper end thereof to the upper portion of the mast, a gantry disposed at a rear portion of the swing unit, and a counterweight car with a counterweight placed thereon, in which the counter weight car is vertically pivotably and removably connected to the rear portion of the swing unit through a connecting arm, a strut is connected between an upper portion of the counterweight car and an upper portion of the gantry, a guy rope is connected between the upper portion of the counterweight car and the swing unit below the gantry, and a lower end of the mast guy line is attached to the counterweight car so that it can be detached therefrom and attached to an upper end portion of the gantry.

Thus, the counterweight car and the crane body are connected not only through the connecting arm but also the strut and the guy rope, whereby under a large hanging load the crane body and the counterweight car cooperate with each other so that the resultant resisting force acts on the mast through the mast guy line located between the mast and the counterweight car. This counterbalancing type crane can also be used as an ordinary type crane by removing the connecting arm from the crane body, then detaching the lower end of the mast guy line from the counterweight car and attaching it to the gantry of the crane body.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF A PREFERRED EMBODIMENT

Figure 1:
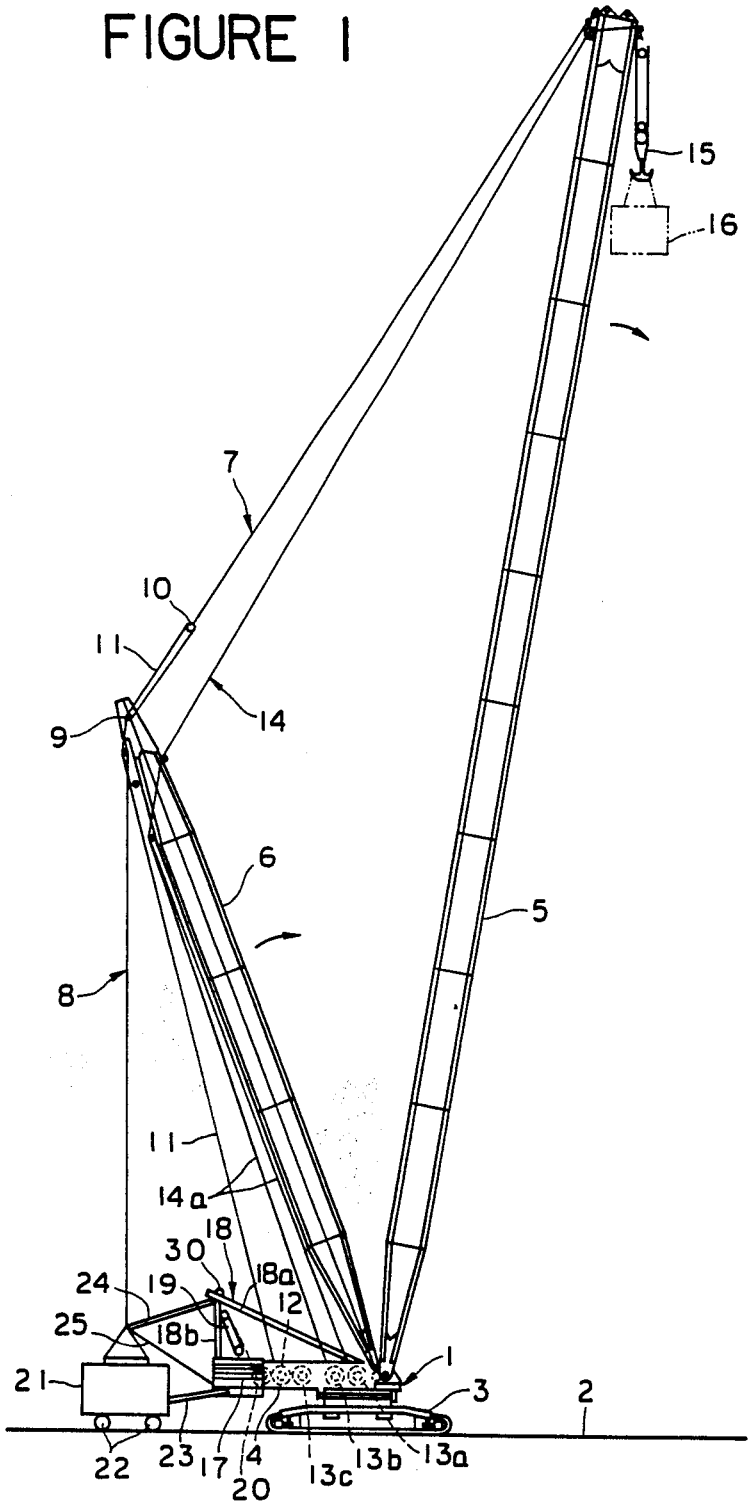
FIG. 1 is a front view of the entirety of a counterbalancing type crane according to are embodiment of the present invention.

Referring first to a FIG. 1, there is illustrated the entire structure of a counterbalance type crane according to are embodiment of the present invention, in which a crane body 1 is composed of a travelling unit 3 capable of travelling on the ground 2 and a swing unit 4 mounted swingably on the travelling unit 3. Numerals 5 and 6 denote a boom and a mast, respectively, whose lower end portions are pivotally connected to the swing unit 4 and which are tiltable in the same vertical plane. The boom 5 and the mast 6 are supported by a boom guy line 7 and a mast guy line 8 in a forward (rightward in the figure) inclined state and a rearward (leftward in the figure) inclined state at a predetermined angle, respectively.

The boom guy line 7 is provided between an upper portion of the boom 5 and an upper portion of the mast 6. At its portion on the side of the mast 6 a boom operating rope 11 is stretched over a fixed sheave 9 mounted on the upper portion of the mast 6 and a movable sheave 10 in opposed relation thereto. The boom operating rope 11 is extending from a winch 12 provided in the swing unit 4. The rope 11 is drawn out or in via the winch 12 to change the length of the boom guy line 7 thereby causing the boom 5 to be raised or lowered. An upper end of the mast guy line 8 is attached to the upper portion of the mast 6 and a lower end thereof attached to a counterweight car 21.

From the main winches 13*a*, 13*b* and an auxiliary winch 13*c*, which are mounted in the swing unit 4, are drawn out main hoist ropes which constitute a hoisting line 14 as well as an auxiliary rope (not shown). The hoisting line 14 is extended beyond the upper portion of the mast 6 and an upper end of the boom 5. It is provided with a hanger 15 at a lower end of its extending portion to vertically movably hang a load 16. To a rear portion of the swing unit 4 are attached a counterweight 17, a gantry 18, a mast operating rope 19 and a winch 20 for the rope 19.

The counterweight car 21, which is disposed behind the crane body 1, is capable of moving freely on the ground 2 through swivel wheels 22 and is connected to a rear end of the swing unit 4 through a connecting arm 23, strut 24 and guy rope 25.

Figure 2:
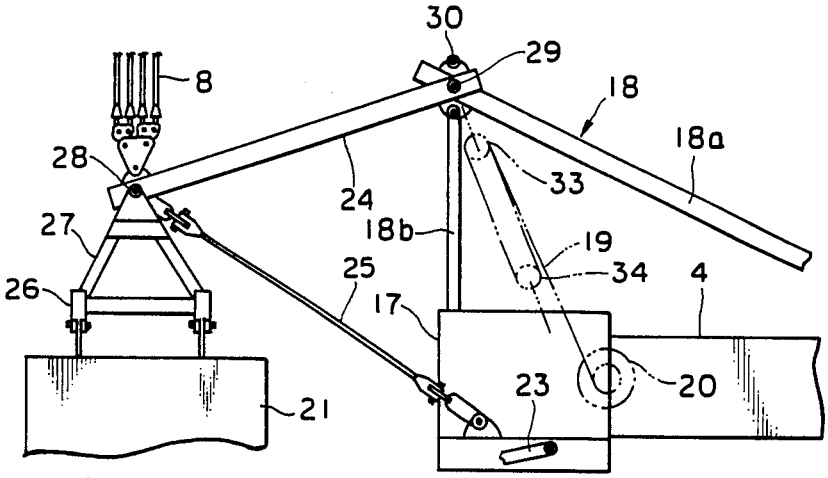
FIG. 2 is an enlarged front view of a principal portion of the crane of FIG. 1.
Figure 3:
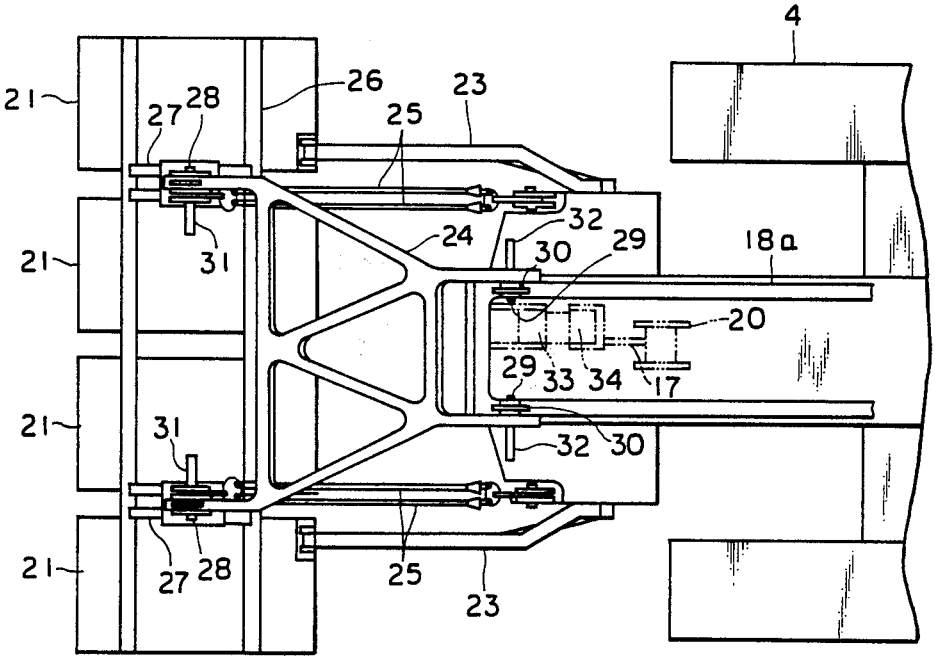
FIG. 3 is an enlarged plan view thereof.
Figure 4:
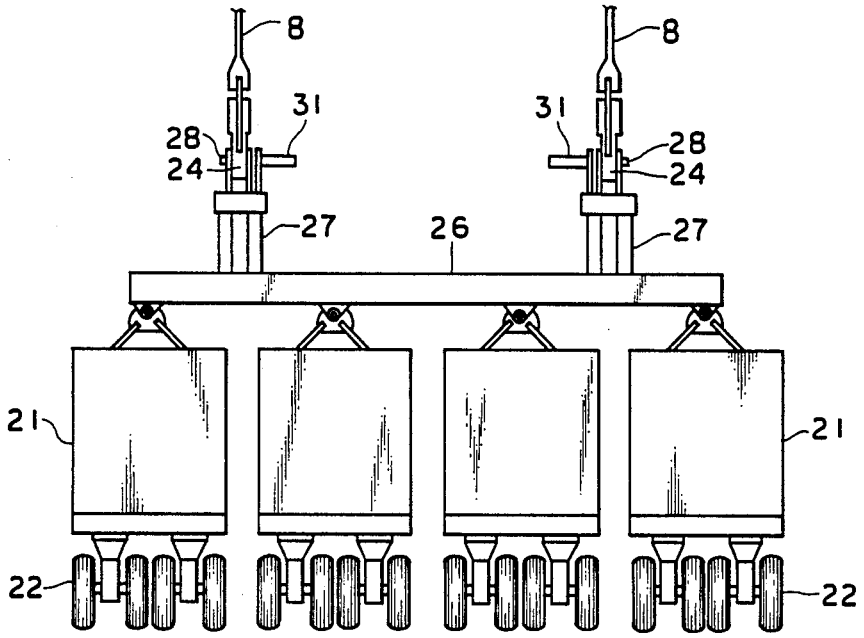
FIG. 4 is an enlarged side view thereof.

Referring now to FIGS. 2 to 4, there is illustrated an example of the connection between the crane body 1 and the --counterweight car 21. In this example there are used four counterweight cars 21 which are arranged side by side and interconnected in this state through a connecting frame 26. One end of each of a pair of connecting arms 23 are pivotally connected to lower end portions of the counter weight cars 21 located on both sides, while opposite ends of the connecting arms 23 are pivotally removably connected to side portions of the lower rear end of the swing unit 4. Through the connecting arms 23 the counterweight cars 21 are connected to the crane body 1 so that they are vertically pivotable and can move with travelling motion of the crane body 1 or swing motion of the swing unit 4. Further, from the connecting frame 26, in positions close to both right and left ends, there extend projecting portions 27 upward, and lower ends of mast guy lines 8 are removably attached to upper ends of the projecting portions 27. Also, one end of struts 24 and guy ropes 25 are connected to the upper ends of the projecting portions 27 each through a horizontal pin 28. Opposite ends of the struts 24 are connected through pins 29 to an upper end of a gantry 18 provided in the swing unit 4 of the crane body 1, and opposite ends of the guy ropes 25 are connected to the rear portion of the swing unit 4 located below the gantry 18. The struts 24 and guy ropes 25 can be easily removed by actuating the connecting pins 28 and 29 by means of hydraulic cylinders 31 and 32. The guy ropes 25 are loosened moderately in advance to permit vertical motions of the counterweight car 21 which follow the contour of the ground 2.

The upper end of the gantry 18 is provided with mounting portions 30 which permit the lower ends of the mast guy lines 8 to be attached thereto at the time of rearrangement. The gantry 18 is composed of an inclined compression member 18*a* and a tension member 18*b* projecting upward nearly vertically from the rear end of the swing unit 4, the compression member 18*a* and the tension member 18*b* being connected at the respective upper end portions. A lower end of the compression member 18*a* is pivotally connected to the swing unit 4, while a lower end of the tension member 18*b* is removable with respect to the swing unit 4. By so doing, when the lower end of the tension member 18*b* is connected to the swing unit 4, the gantry 18 is fixed, while when the lower end of the tension member 18*b* is removed from the swing unit 4, the compression member 18*a* becomes pivotable about its lower end portion. To the upper end of the compression member 18*a* is connected a mast operating rope 19 through sheaves 33 and 34, the rope 19 being drawn out from a winch 20.

In this counterbalancing type crane, as the load 16 is hung, the boom 5 and the mast 6 try to tilt in the direction of arrow in FIG. 1 but are prevented from tilting because the boom guy line 7 and mast guy line 8 are stretched, and a tension porportional to the hanging load W acts on the boom guy line 7 and mast guy line 8. If the hanging load W is large and the tension applied to the mast guy line 8 exceeds the weight of the counterweight car 21, the car 21 will rise. But when the car 21 rises a little, the guide rope 25 is stretched and force is transmitted also to the strut 24 and the guy rope 25 as well as the gantry 18 connected thereto. In this state, the crane body 1 and the counterweight car 21 are united through the guy rope 25 and the strut 24, so that not only the counterweight car 21 but also the crane body 1 serves as a weight which resists the hanging load W, thus making it possible to bear the large load W.

Figure 5:
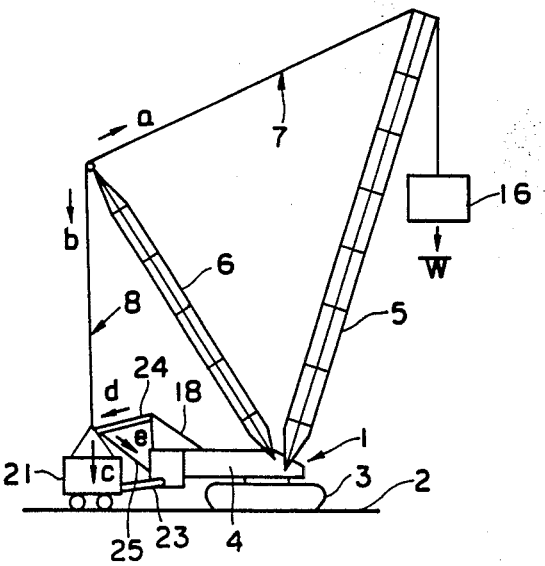
FIG. 5 is a schematic view for explanation of operation.
Figure 10:
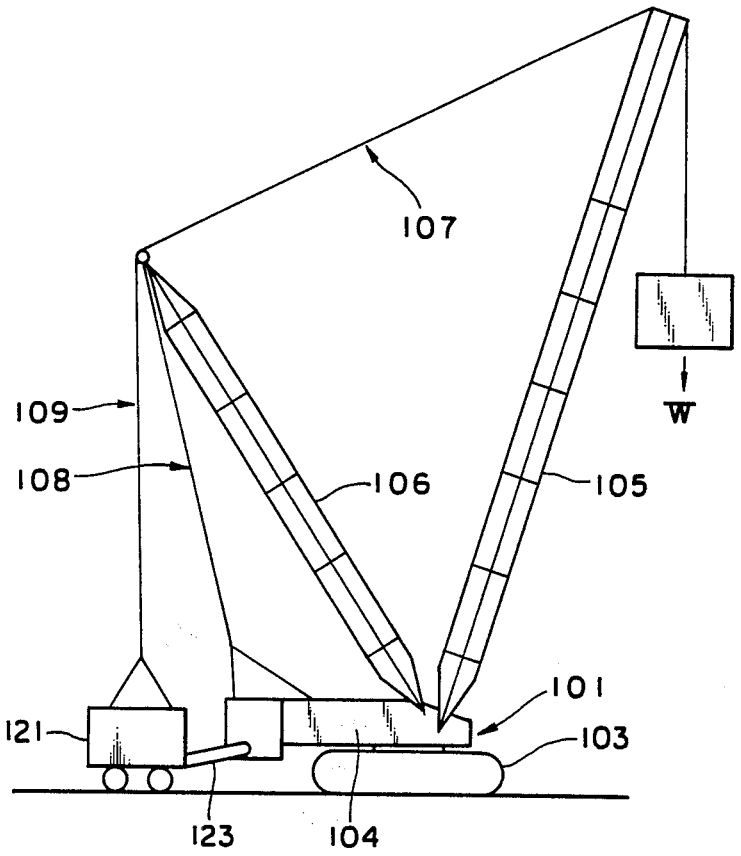
FIGURE 10 PRIOR ART
FIG. 10 is a schematic view of a conventional counterbalancing type crane.

In this state, as shown in FIG. 5, a tension (arrow "a") applied to the boom guy line 7 and a tension (arrow "b") applied to the mast guy line 8 are exerted on the mast 6 under the hanging load W, and the tension of the mast guy line 8 is induced by the weight (arrow "c") of the counter weight car 21, the compressive force (arrow "d") of the strut 24 and the tension (arrow "e") of the guy rope 25. In such a counterbalancing type crane of the present invention, if the forces acting on the mast 6 are expressed in terms of a vector diagram, the result of which is as indicated by solid lines in FIG. 6. On the other hand, a vector diagram in the foregoing conventional counterbalancing type crane (shown in FIG. 10) is as indicated by dash-double dot lines in the same figure.

Figure 6:
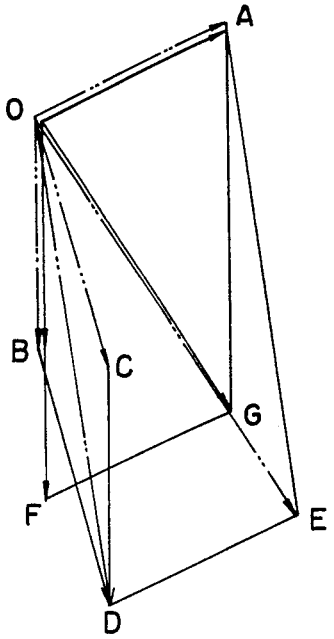
FIG. 6 is a vector diagram of forces acting on a mast.

As is apparent from FIG. 6, the compressive force applied to the mast 6 is smaller in the crane of the present invention than in the conventional crane. In this figure, $\overrightarrow{OA}$ represents the tension of the boom guy line and $\overrightarrow{OB}$ represents the weight of the counter weight car. In the conventional crane, this weight ($\overrightarrow{OB}$) acts as the tension of the guy line (third guy line 109) located between the mast and the counterweight car, and tension ($\overrightarrow{OC}$) is applied also to the guy line (second guy line 108) located between the mast and the crane body. The resultant force ($\overrightarrow{OD}$) of $\overrightarrow{OB}$ and $\overrightarrow{OC}$ acts as a resisting force which resists the tension ($\overrightarrow{OA}$) of the boom guy line to support the mast at a certain angle, and the resultant force of $\overrightarrow{OA}$ and $\overrightarrow{OD}$ acts as a compressive force ($\overrightarrow{OE}$) applied to the mast. In this case, since the guy line between the mast and the crane body is at a small angle with respect to the mast, the compressive force applied to the mast increases. On the other hand, in the crane of the present invention, the weight ($\overrightarrow{OB}$) of the counterweight car 21, as well as the resultant force ($\overrightarrow{BF}$) of the tension of the guy rope 25 and the compressive force of the strut 24, as a resisting force from the crane body 1, act on the mast guy line 8, and the sum ($\overrightarrow{OF}$) of these becomes the tension of the mast guy line 8. Further, the resultant force of this tension of the mast guy line 8 and the tension of the boom guy line 7 as a compressive force ($\overrightarrow{OG}$) applied to the mast 6. In this case, the force ($\overrightarrow{BF}$) to compensate for the deficiency in the resisting force based on the weight of the counterweight car 21 against the hanging load W also acts on the mast guy line 8 located between the mast 6 and the counter weight car 21 and having a relatively large angle to the mast 6, so that the compressive force applied to the mast 6 becomes smaller than in the conventional crane.

Figure 7:
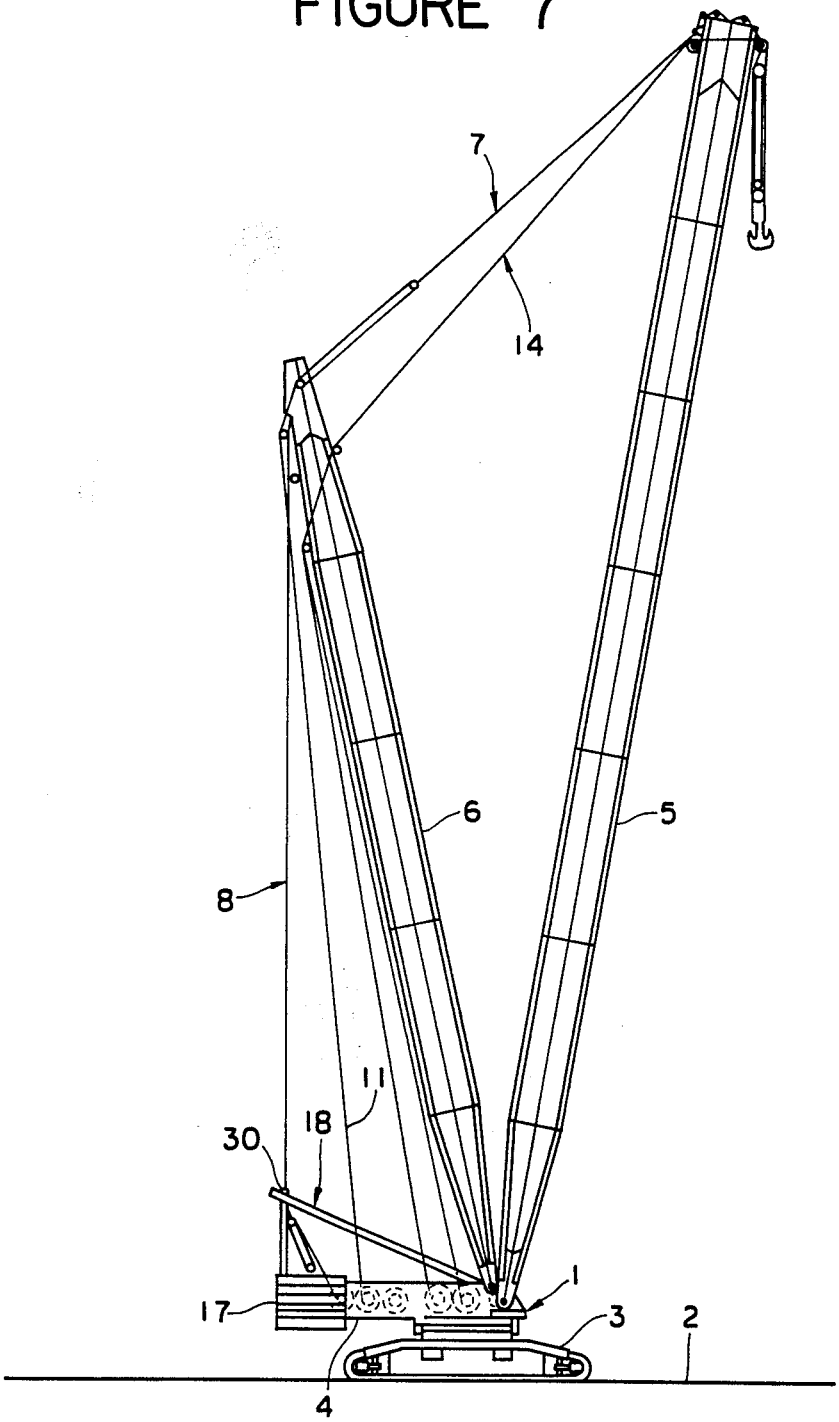
FIG. 7 is a front view of the crane of the invention as rearranged for use as an ordinary type crane.
Figure 8:
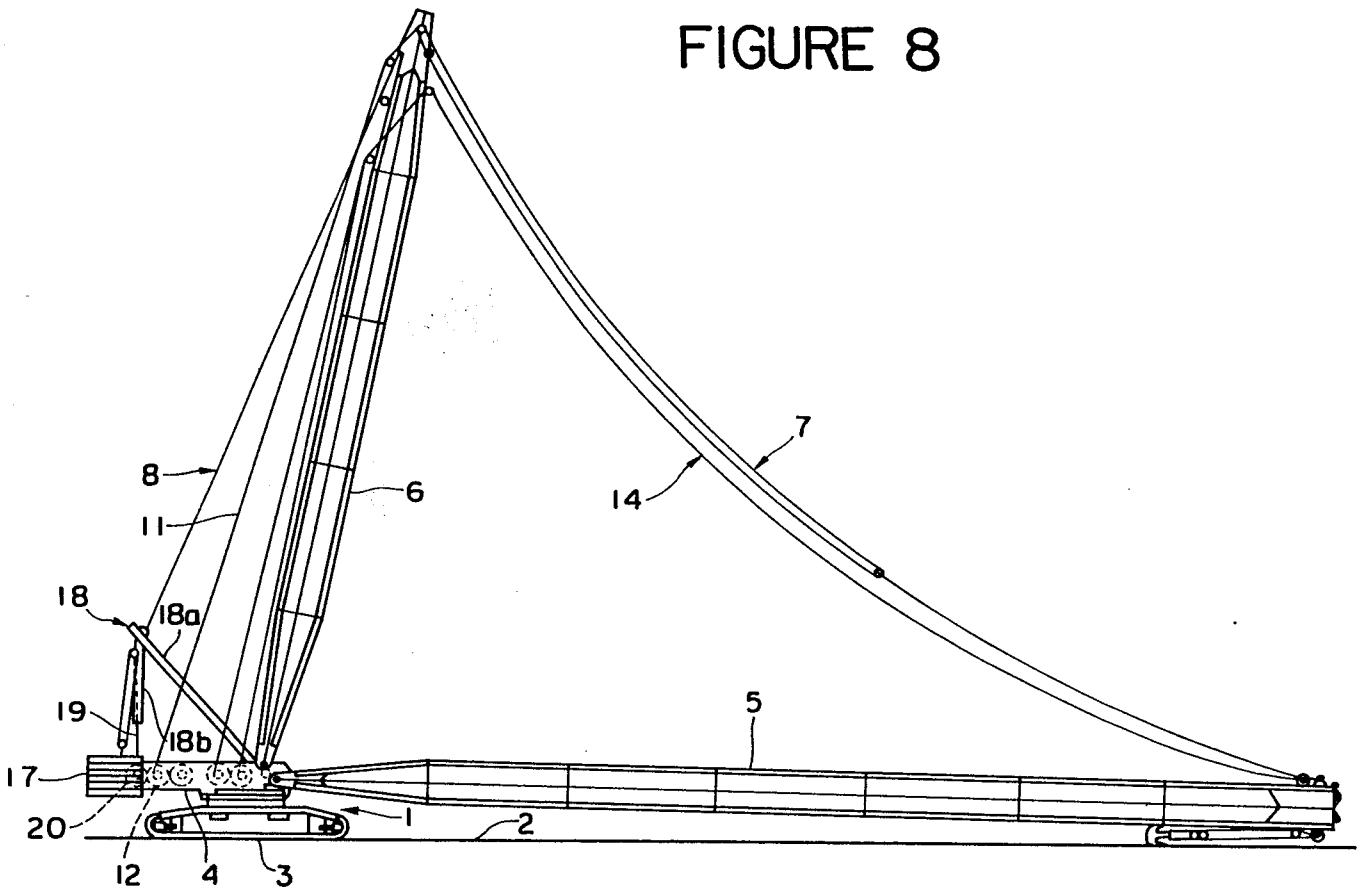
FIGS. 8 and 9 are explanatory views showing an operation procedure for rearranging from the ordinary type crane to the counterbalancing type crane.
Figure 9:
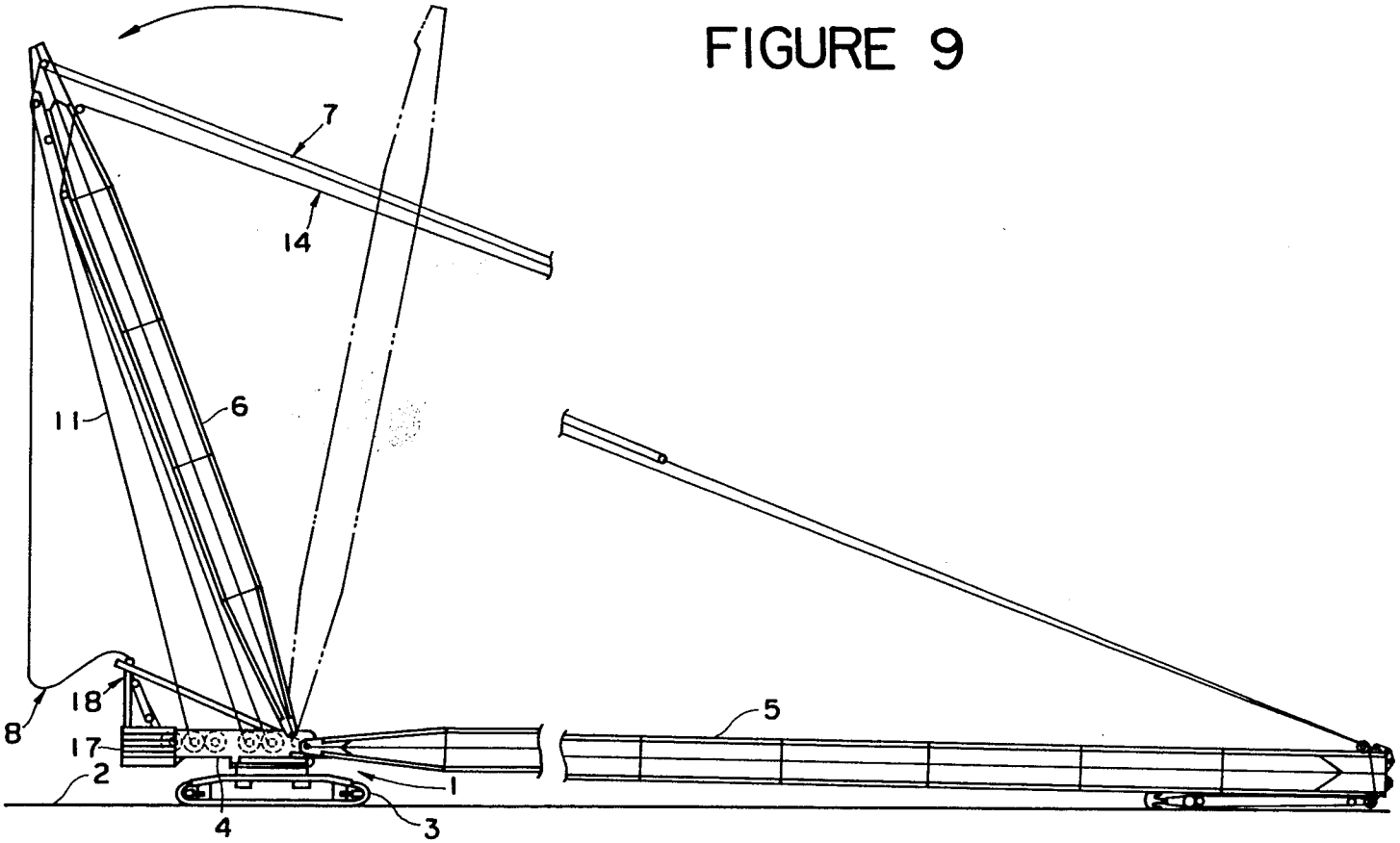

The crane of the present invention can also be used as an ordinary type crane by removing the counterweight car 21 from the crane body 1, then attaching the lower end of the mast guy line 8 to the mounting portion 30 at the upper end of the gantry 18 and, if necessary, replacing the boom 5 with one of the ordinary type crane (e.g. a shortened one), as shown in FIG. 7. From this state the crane can be rearranged into the counter balancing type crane by the following procedure. First, as shown in FIG. 8, the boom operating rope 11 is drawn out from the winch 12 to let the boom 5 fall down on the ground 2, then the lower end of the tension member 18*b* of the gantry 18 is removed from the crane body 1 and the mast operating rope 19 is drawn out from the winch 20, allowing the mast 6 to tilt upward to the right up to a state in which the mast 6 is supported by its own weight and the tension of the mast guy line 8. As a result, the boom guy line 7 becomes loose, and in this state there is performed a boom rearranging operation into one for the balancing type crane by, for example, lengthening the boom 5 at an intermediate portion thereof. Then, as shown in FIG. 9, the mast 6 is is tilted counterclockwise in this figure while winding the mast operating rope 19, whereby the mast 6 is inclined upward to the left, so that the boom guy line 7 located between the mast 6 and the boom 5 is stretched. Then, the lower end of the tension member 18*b* is attached to the swing unit 4 of the crane body 1 to fix the gantry 18. In this state, the mast 6 is supported by the boom 5 through the boom guy line 7 and the mast guy line 8 is loose, so the lower end of the mast guy line 8 can be removed from the gantry 18. Thereafter, the counter weight car 21 is disposed behind the crane body 1, then the connecting arm 23, strut 24 and guy rope 25 are connected therebetween and the lower end of the mast guy line 8 is attached to the upper end of the counterweight car 21. Further, the boom 5 is raised by winding the boom operating rope 11, whereby the mast guy line 8 is stretched. Now the rearrangement to the counterbalancing type crane shown in FIG. 1 is over. Rearrangement from the counterbalancing type crane to the ordinary type crane can be effected by a procedure almost reverse to the above.

Thus, it is possible to effect rearrangement between the counterbalancing type crane and the ordinary type crane in a simple manner. Particularly, the mast guy line 8 is used in common to both the counterbalancing type crane and the ordinary type crane by merely changing its retaining position between the counter weight car 21 and the gantry 18 of the crane body 1, so unlike the prior art the handling of the mast guy line causes no problem at the time of rearrangement to the ordinary type crane.

According to the present invention, as set forth hereinabove, a counterweight car is connected to the crane body removably through a connecting arm and a mast guy line is provided between an upper portion of the mast and the counterweight car. Further, a strut and a guy rope are connected between an upper portion of the counterweight car and an upper portion of the gantry of the crane body as well as a portion therebelow of the crane body. As a result, against a large hanging load, the counterweight car and the crane body are united and the resultant resisting force acts on the mast through the mast guy line located between the mast and the counterweight car, thereby permitting hoist of the large load. Moreover, it is possible to reduce the compressive force applied to the mast in comparison with the conventional counterbalancing type crane, thus permitting reduction in weight of the mast. In addition, since the crane body and the counterweight car are connected by not only the connecting arm but also the strut, the strength of the connection against the sideways falling force of the crane is enhanced to prevent damage of this portion, that is, the action for preventing a sideways falling of the crane is enhanced. Additionally, the crane can also be used as an ordinary type crane by removing the counterweight car. Especially, a single system mast guy line is adopted instead of the conventional two systems, and by changing its retaining position between the counterweight car and the gantry of the crane body, the crane can be used not only as the counterbalancing type crane but also as the ordinary type crane, thus facilitating the rearrangement between the two.

Obviously, numerous modifications and variations of the present invention are possible in light of the above teachings. It is therefore to be understood that within the scope of the appended claims, the invention may be practiced otherwise than as specifically described herein.

What is claimed is:

1. A counterbalancing type crane, comprising:

a crane body which comprises a travelling unit and a swing unit, a tiltable boom mounted on said crane body for hanging a load through a hoisting line;

a tiltable mast mounted on said crane body;

a boom guy line disposed between an upper portion of said mast and an upper portion of said boom, said boom guy line being changeable in length;

a mast guy line attached at an upper end thereof to the upper portion of said mast;

a gantry disposed at a rear portion of said swing unit and having a mounting portion located an an upper portion thereof; and a counterweight car with a counterweight placed thereon;

connecting arm means for vertically pivotably and removably connecting said counterweight car to the rear portion of said swing unit;

a strut connected between an upper portion of said counterweight car and an upper portion of said gantry;

a guy rope connected between the upper portion of said counterweight car and said swing unit below the gantry, wherein a lower end of said mast guy line is attached to said counterweight car so as to be detachable therefrom and attachable to said mounting portion of said gantry.

2. A counterbalancing type crane as set forth in claim 1, wherein said gantry comprises an inclined compression member pivotably connected to said swing unit and said mounting portion and a removable tension member pivotably connected to and projecting upwardly from a rear end portion of said swing unit and connected to said mounting portion.

* * * * *